US006168715B1

(12) United States Patent
Schulze-Eyssing

(10) Patent No.: US 6,168,715 B1
(45) Date of Patent: Jan. 2, 2001

(54) DEVICE FOR OIL TREATMENT OF SINTERED PARTS

(75) Inventor: Heinz Schulze-Eyssing, Dielheim (DE)

(73) Assignee: Turbo-Clean GmbH, Walldorf (DE)

( * ) Notice: Under 35 U.S.C. 154(b), the term of this patent shall be extended for 0 days.

(21) Appl. No.: 08/945,285

(22) PCT Filed: Feb. 13, 1997

(86) PCT No.: PCT/DE97/00275

§ 371 Date: Oct. 14, 1997

§ 102(e) Date: Oct. 14, 1997

(87) PCT Pub. No.: WO97/29853

PCT Pub. Date: Aug. 21, 1997

(30) Foreign Application Priority Data

Feb. 15, 1996 (DE) ..... 196 05 576

(51) Int. Cl.[7] ..... B05C 3/02; B05C 3/109; B04B 1/00

(52) U.S. Cl. ..... 210/360.1; 210/380.1; 494/40; 494/47; 494/48; 360/232; 360/234; 118/52; 118/418

(58) Field of Search ..... 118/418, 52; 366/234, 366/232, 219, 220, 47; 494/48, 47, 40; 210/360.1, 380.1

(56) References Cited

FOREIGN PATENT DOCUMENTS

4100414 * 4/1992 (DE) .
0 172 304 * 9/1982 (EP) .
7252505 * 10/1995 (JP) .
8102699 * 10/1981 (WO) .
82/03030 * 9/1982 (WO) .

* cited by examiner

*Primary Examiner*—David A. Reifsnyder
(74) *Attorney, Agent, or Firm*—Horst M. Kasper

(57) ABSTRACT

The invention concerns a device for the oil treatment of sintered parts consisting of a drum (11, 111) which is mounted so that it can rotate about a vertical axis and which can be driven. It has a drum mantle (11', 111') and loading and unloading devices so that it can be loaded and unloaded axially, a floor that tightly closes the opening in the floor (19, 119) against the-drum mantle (11', 111'), connections (28, 29, 30, 31/128, 129, 130, 131) leading into the drum (11, 111) for liquid and gaseous treatment media for carrying out the treatment phases, and outlets (35, 135) for letting treatment fluids out of the drum (11, 111). The task of the invention is to create a device that not only mechanizes the treatment process but also can be repeated many times, always in the same way. This problem is solved by the connections (28, 29, 30, 31/128, 129, 130, 131) being arranged to lead axially into the loading opening and the outlets (35, 135) through the drum mantle (11', 111').

14 Claims, 3 Drawing Sheets

DEVICE FOR OIL TREATMENT OF SINTERED PARTS

Figure 1:
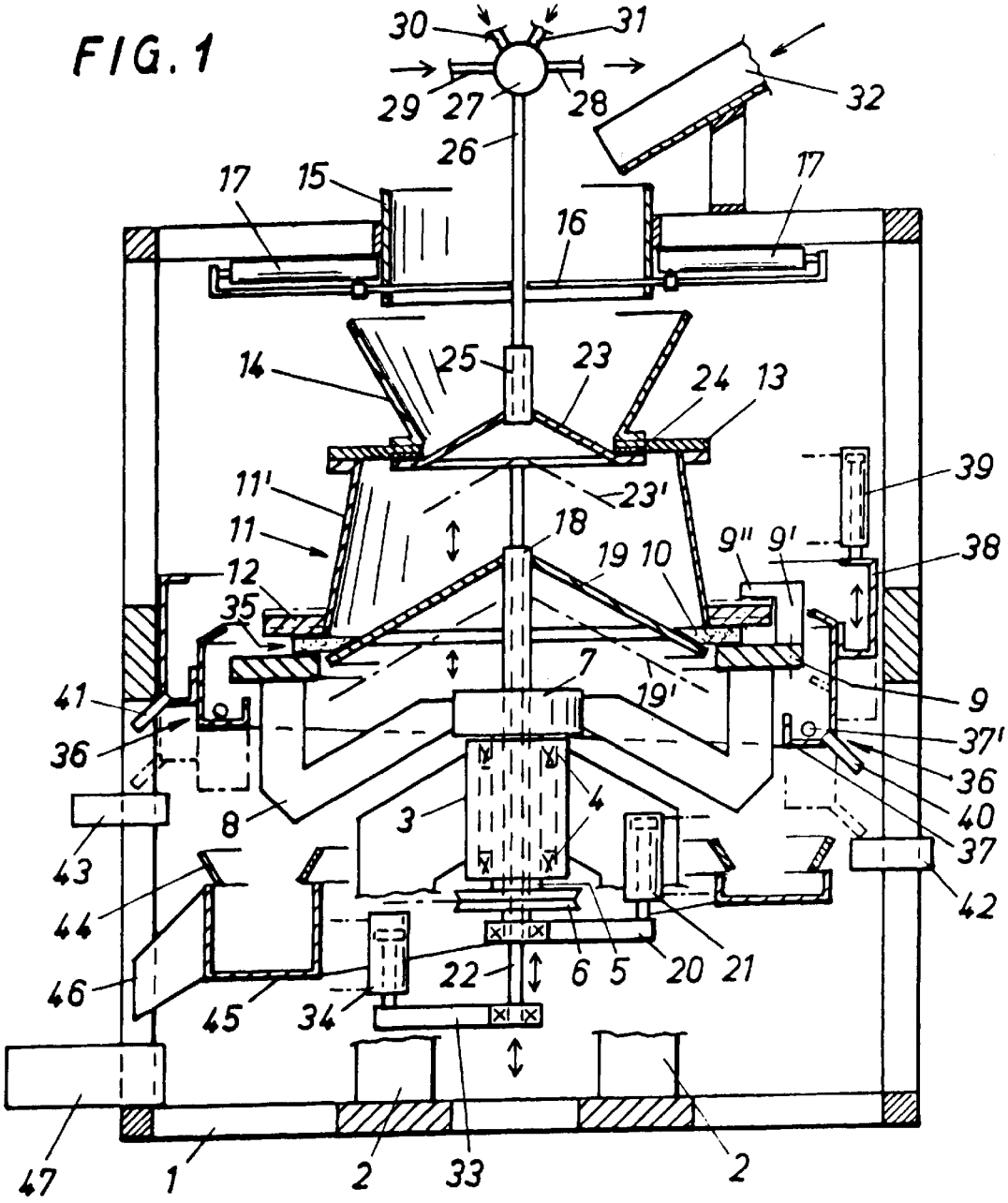

The invention concerns a device for the oil treatment of sintered parts consisting of a drum which is mounted so that it can rotate about a vertical axis and which can be driven. It has a drum mantle and loading and unloading devices so that it can be loaded and unloaded axially, a floor that tightly closes the opening in the floor, connections leading into the drum for liquid and gaseous treatment media for carrying out the treatment phases, and outlets for letting treatment fluids out of the drum.

One of the types of treatment is based on immersing porous parts, or parts containing porous layers, such as sintered parts, in order to improve their sliding behavior. An impregnation process is already known from JP 07252505 A; for holding the parts, this invention uses a perforated rotating inner drum which can be driven and which displays a vertical axis mounted in a stationary, full-walled external drum. The loading and unloading opening is located at the top and can be sufficiently tightly sealed to withstand pressure by means of the lid that can be placed on the outer drum. Connections are attached to the outer drum to evacuate the drum and fill it with air, and to feed immersion and washing liquids in and let them out. As the outer drum has to have sufficient radial distance between itself and the inner drum in order to permit the inner drum to swivel outwards while it is rotating, the holding capacity of the outer drum has to be sufficient to take the relevant quantity of immersion and washing fluid for treating the sintered parts in the inner drum. Accordingly, the times taken for evacuation, filling with air, and pumping impregnation and washing liquids in and out are that much longer, so that the treatment cycle requires a considerable amount of time and treatment fluid in total, and this all entails costs. Admittedly, it is possible to load by pouring liquids into the inner drum, but unloading either entails taking out the inner drum with the aid of lifting equipment and tipping it out, or else the parts have to be lifted out, by hand if necessary, and this means an additional expenditure of time and money. In particular, this unloading process interrupts the flow of treatment of the sintered parts, so that an impregnation device of this kind cannot be inserted into an automatic processing line for sintered parts.

Another device is known from WO 82/03 030 A1 for impregnating porous parts in which three top-shaped covers which can be moved along a vertical axis but not rotated can be lowered onto moving parts placed on a suitable conveyor into three different treatment positions, with the inside of the lid being closed tightly enough to withstand pressure in the first position. This can be evacuated, ventilated, and filled with or emptied of impregnation liquid. In the second position the parts can be spun, and washed and if necessary dried in the third position. This device is only suitable for a few parts at a time, because there is no filling basket available. The connections for evacuating the container, filling it with air, and for filling and emptying are fixed to non-rotating parts. This already familiar device, again, is not only expensive but also cannot be used in an automatic treatment line because it has no automatic loading or unloading facility. Finally, it is not possible to guarantee a constant level of quality because the parts are impregnated and washed when the device is standing still.

Yet another impregnating device is familiar from WO 81/02 699 A1 in which a bell is placed over the tank containing the parts to be impregnated and sealed in such a way as to withstand pressure. Evacuating the bell causes the impregnation liquid to be drawn into it. The seal between the bell and the tank is created by a double seal fitted to a flange on both sides, from which one seal is released when the bell is raised. The double seal has no effect on the emptying or loading of the bell. This device is likewise not suitable for inclusion in a continuous-process plant, because after the washing process, which takes place in a separate washing tunnel, there has to be a dripping and drying phase and this would represent an unacceptable delay to the treatment process.

Another part of oil treatment is removing the grease from parts completely covered in oil. A device for this purpose is known from DE 41 00 414 C1 for degreasing mass-produced parts such as bearing sleeves, in which the parts are placed in a drum with a perforated drum wall and then spun, with the oil thus expelled being retrieved and immediately re-used. The drum is open in its short wall for loading, and the floor can be raised for unloading. Only one spinning cycle takes place, and immersion beforehand is not possible.

The task of the present invention is therefore to create a device for the oil treatment of sintered or similar parts which not only mechanizes the treatment process but also can be repeated many times, always in the same way, so that a treatment process emerges for producing a uniformly oil-treated product.

The invention solves this problem by arranging the connections axially in the loading opening and leading the outlets through the drum mantle.

The advantages achieved by this invention consist mainly in the fact that there is now only one single closed device for the whole process of oil treatment, which even includes the washing and preserving cycles that follow, working practically in one continuous process without any manual work or separate devices being necessary for any of the individual working steps. This not only does away with baskets for transporting the sintered parts but also makes the time-consuming dripped time superfluous. The immersion oil does not become contaminated, so the immersion oil expelled by spinning can be re-used immediately. The unpleasant odor that has arisen so frequently in the past is greatly reduced. In the same way, the danger of floor contamination is eliminated and the oil treatment of sintered parts goes more quickly and precisely following this invention. It is easier for a person to operate than previous devices, and in addition to this permits the environmentally friendly production of sintered parts with lower oil consumption.

Further characteristics of the invention form the substance of the subordinate claims.

Examples of the implementation of the invention are shown in the drawing and explained in more detail below.

The following are shown:

FIG. 1: lateral cross-section of the device

Figure 2:
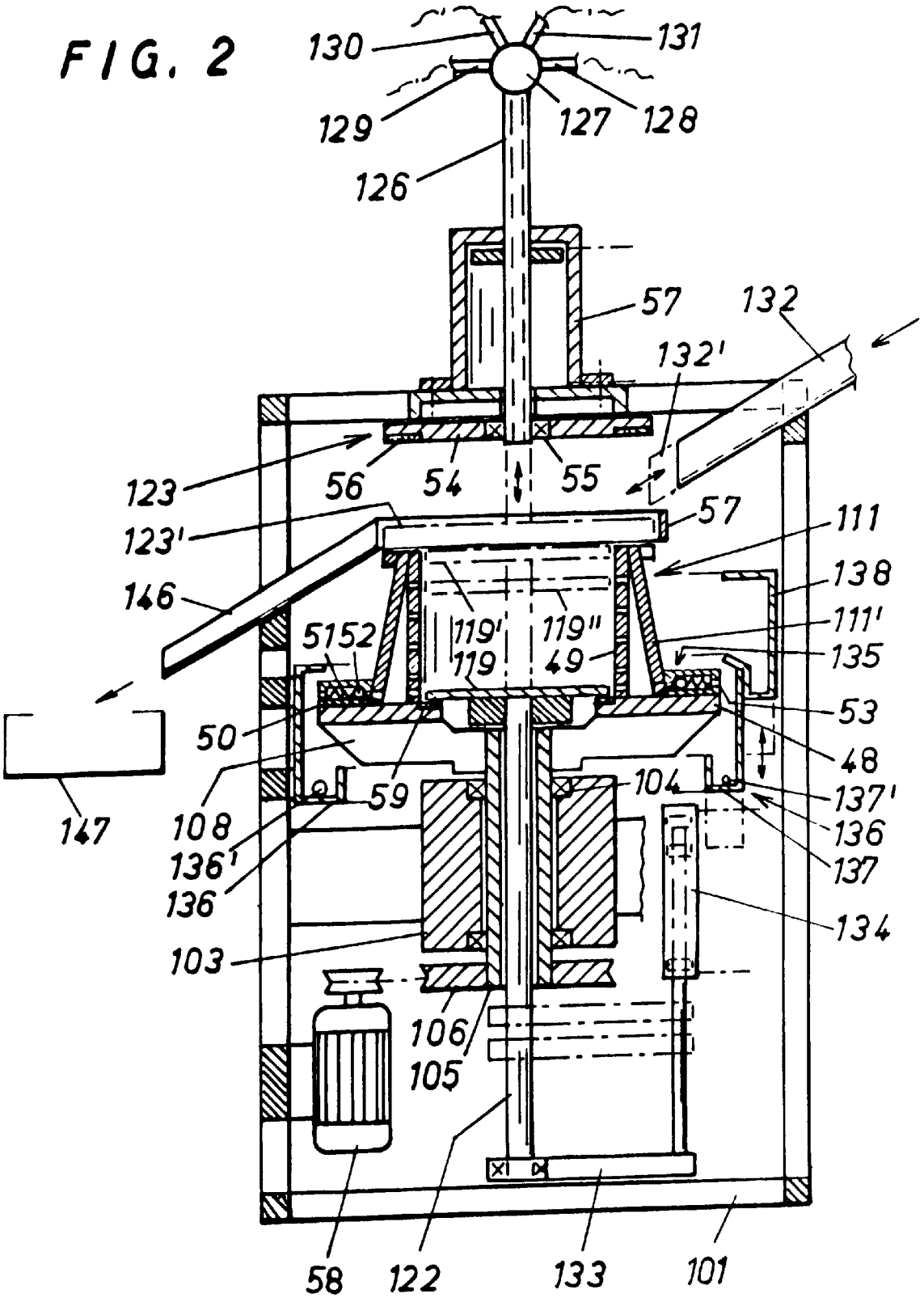

FIG. 2: cross-section of a different version of the device

Figure 3:
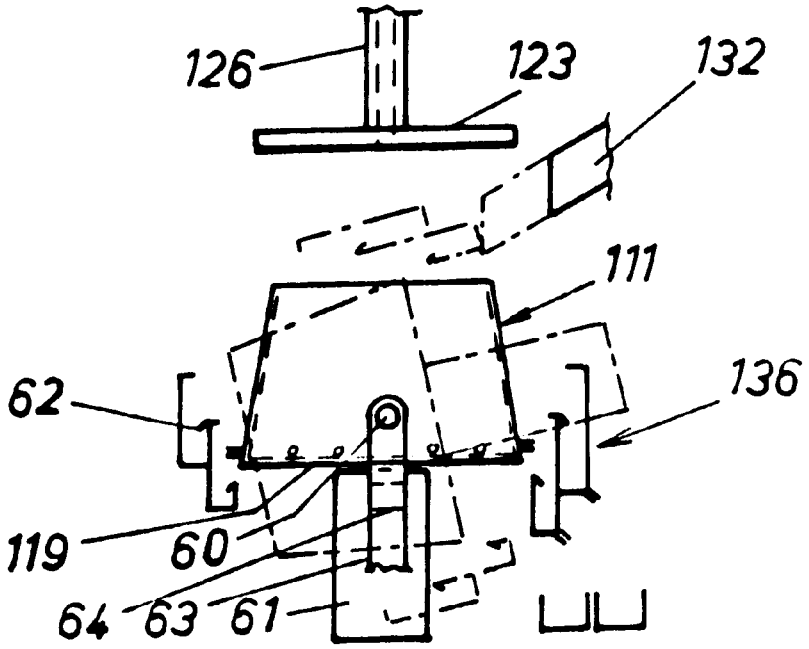

FIG. 3: a schematic representation of yet another version.

The invention is explained on the basis of a device for immersing sintered or similar parts in oil. As FIG. 1 shows, this device consists of a roughly box-shaped frame 1 in which a hollow cylinder 3 is set roughly in middle, on supports 2, with a vertical axle. A hollow spindle 5 is held inside in rotating bearings 4. At the lower end of the spindle, which juts out from the hollow cylinder 3, there is a drive wheel 6 driven by a variable-speed electric motor (not illustrated). At the top end of the hollow spindle 5 there is a holding ring 7 on the outside of which a number of roughly shaped radial carrier arms 8 are attached at uniform intervals. At the free ends of the carrier arms 8, there is a horizontal carrier ring 9 that serves as a stationary support for the valve ring 10 which overhangs the carrier ring 9 more or less radially on the inside. Above this there is a drum 11 which displays a drum mantle 11' widening conically towards the bottom and made of a full, unperforated steel. The bottom end of this is surrounded by a sealing ring 12 that can be placed on the valve ring 10 tightly enough to withstand pressure, while at the top end there is a ring washer 13 on which in turn a filling hopper 14 is placed. Coaxially above this is a cylindrical filing box 15 attached to the frame 1, the lower emptying orifice of which can be closed by means of the slide 16. The slide can be moved by a hydraulic actuator cylinder 17 from the closed to the open position and back.

A hollow axle 18 runs through the hollow spindle 5 which carries at its lower end a base 19. This can, for instance, be open downwards and conical and when in the closed position (as illustrated) presses from underneath against the valve ring 10 firmly enough to make a pressure seal. The end of the hollow axle 18 jutting out downwards can be rotated and is carried in such a manner that it can rotate on a horizontal positioning arm 20, at the other end of which a positioning cylinder 21 is arranged parallel to the hollow axle 18. A positioning rod 22 runs through the hollow axle 18 and carries a cover 23 at the top end, likewise conical in shape, the circumference of which rests in the closed position against a sealing ring 24 attached to the ring washer 13 on the inside of the drum to form a pressure seal. A rotating sleeve 25 is arranged centrally on cover 23 in which a stationary supply tube 26 is led in such a way that it can be moved rotarily and axially and can also form a pressure seal. Its upper end carries a valve head 27 into which a number of connections lead for supply units. Thus, for instance, connection 28 can be connected to a vacuum unit which could consist of a vacuum pump fitted ahead of a vacuum tank. Connection 29 could be connected to an immersion oil lead, for the purpose of dosing in immersion oil which would be constantly heated to ensure that it flowed thinly. Connection 30 serves the purpose letting in air, and connection 31 for letting in a washing agent. Each of the connections 28 through 31 should advisedly be allocated to a pipe inside supply pipe 26. The drum 11 is loaded from a loading chute ending above the filling box 15. At the other end of the positioning rod 22 there is a positioning arm 33, mounted in such a way that it can rotate and through which a positioning cylinder 34 can be raised and lowered in order to move cover 23 to the open or closed position.

The valve ring 10 and the sealing ring 12 between them form a valve 35 that in the closed position seals the drum 11 tightly to the outside and in the open position (in which the drum 11 is only raised a few millimeters) creates a gap through which fluids can escape outwards. In the outlet area of valve 35, a ring-shaped catching runnel 36 is mounted radially on the outside. In the practical example illustrated, the catchment runnel 36 takes the form of a double catchment runnel with a lower catchment runnel 37 located in the outlet area of valve 35 and an upper catchment runnel 38 projecting upwards. The catchment runnel 36 is mounted so that it can be adjusted for height, and can be positioned by positioning cylinder 49 in the appropriate catching position. The catchment runnel 39 is also arranged at an angle and fitted at its lowest point with two outlet pipes, 40 and 41, to each of which a catchment tank, 42 or 43, is allocated. In order further to ensure that the immersion oil flows thinly, the catchment runnel 37 can be provided with a heater 37'. Below the carrier arm 8, and in the ring area underneath the outer edge of base 19, there is a ring hopper 44 arranged in a stationary position on frame 1 into which a ring chute 45 empties. The latter is likewise mounted at an angle, and is provided at its lowest point with an outlet chute 46 underneath which a catchment tank 47 is placed.

The device functions in such a way that a portioned quantity of sintered parts drops into the filling box 15 via the loading chute 32 and is stored there. As soon as the immersion process can start, this quantity lands in filling hopper 14, after the slide 16 has opened, and into the drum 11 after the cover 23 has been lowered into the loading position 23' (shown by a dotted line). The material can be loaded with drum 11 either stationary or rotating slowly. Drum 11 is then closed tightly again when the cover 23 is raised. The valve for the connection to the vacuum system then opens in valve head 27, so that drum 11 is evacuated. At the end of the evacuation phase, the valve to connection 29 is opened so that a dosed quantity of pre-heated, meaning thin-flowing, immersion oil flows through the supply pipe 26 into drum 11 until all the sintered parts are flooded with immersion oil and the pores of the sinter material are filled with immersion oil. This filling process is achieved solely by the partial vacuum in drum 11, which is maintained by the continued operation of the vacuum system. When the immersion oil has been dosed in, and the two open valves have closed, the valve for connection 30 and drum 11 is filled with air. Evacuation, filling with immersion oil, and refilling with air are all carried out with drum 11 standing still. The immersion oil is than expelled by spinning at a speed appropriate to the sizes and shapes of the sintered parts, and in the process valve 35 is opened by slightly raising drum 11. Drum 11 is carried axially on guides 9' placed on carrier ring 9 and fixed in the raised position by a horizontal stop 9". The immersion oil thus expelled is expelled outwards through the crack created in valve 35, caught in catchment ring 37 (which should advisedly be heated as well), and passed through catchment pipe 40 into catchment tank 42. Once the immersion oil has been expelled, the valve for connection 31 is opened in order to admit a washing agent. Valve 35 is closed at the same time. The speed of rotation of drum 11 can be reduced at this stage. Catchment ring 36 is lowered downwards so that upper catchment runnel 38 lies in the outlet area of valve 35. The mixture of immersion oil and washing agent escaping through the re-opened valve 35 is collected in catchment tank 43 through outlet pipe 41 when drum 11 resumes its speed of rotation. After the washing phase, base 19 drops into the unloading position 19' so that the sintered parts drop out of drum 11 and into ring hopper 44, from where they land in collecting tank 47 via outlet slide 46.

FIG. 2 shows a different version of the device. (Identical parts are provided here with reference numbers 100 higher than in the preceding version.) Here again, hollow cylinder 103 is fixed in a stationary position in frame 101 and the hollow spindle 105 is mounted within it, in the bearing 104, so that it can rotate. At its lower end there is a drive wheel 105, driven by electric motor 58. On the carrier arm 108 arranged at the upper end of the hollow spindle 105 there is a ring-shaped bearing plate 48 on which the drum 111 is mounted. The latter displays a perforated inner mantle 49 mounted radially within the drum mantle 111', which is full-walled and slopes conically downwards. On the outside of drum mantle 111', emerging through a drilled hole in the space between the drum mantle 111' and the inner mantle 49, valve 135 is mounted on bearing plate 48; in this version it consists of a number of individual valves 50 distributed around the circumference of the drum. These display a valve ball 52 pressed against a sealing surface by spring 51. The strength of the spring is such that, during the evacuation phase, valve 135 is closed by the partial vacuum in drum 111 but during the spinning phase centrifugal force causes valve ball 52 to rise, which opens valve 135. As a result, the liquid can be expelled through a drilled hole 53 next to valve 50.

The upper drum aperture is closed by cover 123, which in this case takes the form of a level cover plate 54 and is mounted so that it can rotate around supply pipe 126. The rotating bearing 55 is provided for this purpose, and can be closed to form a seal. In the outer area, a ring seal 56 is arranged on drum 111. The supply pipe 126 is led through a positioning cylinder 57 through which the cover 123 can be moved from the raised, or loading, position illustrated here to the lowered, or closed position 123' shown here as a dotted line. At its upper end, the supply pipe 126 carries the valve head 127 with the connections 128 for the vacuum system, 129 for the immersion oil lead, 130 for the air inlet, and 131 for the supply of washing agent. All the connections 128 through 131 are arranged as flexible hoses in order to be able to compensate for the difference in height of cover 123 between its open and closed positions. In this version again, it is preferable for each of the connections 128 through 131 to be allocated to pipe reaching down to the bottom end of supply pipe 126. The loading chute 132 serves the purpose of loading; it is designed to be pushed outwards in the transportation direction for loading, as indicated by a dotted line 132'.

The base 119 is illustrated as a flat plate, but can also be conical and/or fitted with a number of ribs. It sits securely, the lower end of which is mounted so that it can rotate in the positioning arm 133 that protrudes from hollow cylinder 103. The arm 133, and thus also the base 119, can be raised and lowered by means of positioning cylinder 134. The base 119 can be raised inside drum 111 to an upper end-position in which based 119 and the upper edge of drum 111 both lie in the same plane. This is the unloading position 119'. In order to prevent the parts from falling out sideways as a result of the rotation of the drum during unloading, a frame 57 encircles the drum 111 at the opening in which an outlet chute 146 empties into a collecting tank 147. If large and/or breakable parts are to be loaded, provision can be made for the base 119 to be lowered to an intermediate position 119' in order to reduce the height through which the parts have to fall. During loading, base 119 is then lowered slowly to its lower end-position, in which it sits on and forms a seal with the floor seal 59 of bearing plate 48. Catchment ring 136 is arranged in the outlet area of valve 135, which is illustrated in this example on the right-hand side as double catchment ring 137, 138 and can be adjusted for height. On the left-hand side of FIG. 2, the catchment ring 136 consists of a fixed, single catchment ring in which the expelled immersion oil and the mixture of immersion oil and washing agent are caught in separate tanks arranged below it. This catchment runnel 136 can likewise be provided with a heating system 136' in order to keep the immersion oil running thinly.

The way in which the version shown in FIG. 2 functions is the same as that described in FIG. 1 with the sole difference that it can be loaded from above.

A further practical version is shown in FIG. 3. (This is similar to that shown in FIG. 2, so the same reference numbers have been used.) The drum 111 displays a base 119 that cannot be released from the drum mantle, and is mounted so that it can swivel about a horizontal axis in order to unload the parts as shown by the dotted line. The drive unit 61 mounted underneath and the catchment ring 136 swivel together with drum 111. The latter displays a border 62 on its inner wall, facing inwards, to prevent liquid from running out when it is in the tipped position. Drum 111 is provided at its axis with a stub shaft 60 which is mounted and can rotated in a fixed stand 63. Between the latter and drum 111 there is an intermediate lever fastened on the stub shaft which is fixed at its other end to the drive unit. A tipping mechanism (not illustrated) is connected to a stub shaft 60. The cover 123 is fixed rigidly to the supply pipe 126, which means that cover 123 can only sit on the stationary drum 111 during the evacuation of drum 111 and while it is being filled with immersion oil, but is otherwise raised if only by a very small amount. A fixed arrangement for cover 23 and 123 of this kind is also conceivable in the version shown in FIGS. 1 and 2 if the immersion process is designed to accommodate it.

When cleaning or a change in the type of immersion oil is necessary, the device can be cleaned quite simply by filling drum 11, 111 with washing agent, possibly creating a washing movement by means of fluctuating speeds of rotation, and then expelling it by spinning the drum. A preservative agent could also be fed in through an additional supply connection, after the immersion and expulsion phases, in order to prevent corrosion during the storage phase. The construction of the device can of course be varied without deviating from the principle of the invention.

What is claimed is:

1. A device for the oil-treatment of sintered parts, comprising a drum which is mounted vertically so that it can rotate about a vertical axis and which can be driven, with a drum mantle, devices for loading and unloading the drum in an axial direction, a base which closes a base opening to form a seal against a drum mantle surrounding the drum, a plurality of connections leading into the drum for liquid and/or gaseous treatment media for carrying out the treatment phase, and a plurality of outlets for letting the treatment liquids out of the drum, wherein the plurality of connections is arranged to lead in an axial direction into a loading opening and the plurality of outlets (35, 135) lead through the drum mantle.

2. The device according to claim 1, wherein the drum is fitted with the drum mantle and a loading aperture is formed to be closable by a cover closing to form a seal against the drum.

3. The device along the lines of claim 2, wherein the plurality of connections is led through the cover.

4. The device along the lines of claim 2, wherein the plurality of connections is mounted rigidly to a supply pipe and led axially through the cover, and wherein the cover is fixed so that it is either capable of rotating or fixed rigidly to the supply pipe.

5. The device along the lines of claim 1, wherein the base is mounted so that it can be adjusted in an axial direction.

6. The device along the lines of claim 5, wherein the base inside the loading is movable and capable of being set in at least one position along a longitudinal range.

7. The device along the lines of claim 1, wherein the plurality of outlets is constructed as a valve consisting of a valve ring and a stationary sealing ring surrounding the drum opening, and being capable of being raised in order to open the sealing ring from the valve ring.

8. The device along the lines of claim 7, wherein the base is capable of forming a seal against the valve ring.

9. The device along the lines of claim 7, wherein the cover is capable of being laid on a load side against a ring-shaped seal in an interior of the drum, and wherein the drum is capable of being raised by the cover from an unloading side of a valve ring.

10. The device along the lines of claim 1, wherein the drum is led in an axial direction on an unloading side through guide pieces which horizontal stops are to limit a lift of the drum.

11. The device along the lines of claim 1, wherein a valve consists of one or a number of individual valves, and a valve body which is pressed by a vacuum in the drum against a sealing surface and which can be released by centrifugal force during the rotating of the drum.

12. The device along the lines of claim 11, wherein the drum comprises a perforated inner wall and wherein the valve empties into an intermediate space between the drum and an inner wall.

13. The device along the lines of claim 1, wherein a ring-shaped catchment runnel is allocated on an outside area of the valve wherein the valve can be moved away in an axial direction from the outlet area of the valve.

14. The device along the lines of claim 1, wherein the drum is mounted so that it can be tilted together with a drive unit and a catchment runnel.

* * * * *